US009476167B2

(12) United States Patent
Welch

(10) Patent No.: US 9,476,167 B2
(45) Date of Patent: Oct. 25, 2016

(54) DECKING WALKWAY FOR BEACHES AND OTHER SOFT TERRAIN

(71) Applicant: Michigan Lake Products, Inc., Indian River, MI (US)

(72) Inventor: Gregory P. Welch, Walloon Lake, MI (US)

( * ) Notice: Subject to any disclaimer, the term of this patent is extended or adjusted under 35 U.S.C. 154(b) by 0 days.

(21) Appl. No.: 14/591,616

(22) Filed: Jan. 7, 2015

(65) Prior Publication Data

US 2015/0197899 A1 Jul. 16, 2015

Related U.S. Application Data

(60) Provisional application No. 61/925,968, filed on Jan. 10, 2014.

(51) Int. Cl.
*E01C 5/00* (2006.01)
*E01C 15/00* (2006.01)
*E01C 9/08* (2006.01)

(52) U.S. Cl.
CPC ..... *E01C 15/00* (2013.01); *E01C 5/005* (2013.01); *E01C 9/086* (2013.01)

(58) Field of Classification Search
CPC ..... E01C 5/00; E01C 5/001; E01C 5/003; E01C 9/00; E01C 13/00; E01C 13/04; F16B 17/00
USPC ..... 404/35, 40, 43; 14/73; 403/345
See application file for complete search history.

(56) References Cited

U.S. PATENT DOCUMENTS

| | | | | |
|---|---|---|---|---|
| 4,078,515 | A * | 3/1978 | Svirklys | 114/266 |
| 4,282,619 | A * | 8/1981 | Rooney | 14/6 |
| 4,363,459 | A * | 12/1982 | Holzer | 248/265 |
| 4,635,889 | A * | 1/1987 | Bell et al. | 248/265 |
| 5,820,294 | A * | 10/1998 | Baranowski | 404/36 |
| 5,950,377 | A * | 9/1999 | Yoder | 52/177 |
| 7,214,005 | B1 * | 5/2007 | Davis | 405/114 |
| 7,478,504 | B2 * | 1/2009 | Huebner et al. | 52/238.1 |
| 7,503,150 | B1 * | 3/2009 | diGirolamo et al. | 52/702 |
| 2014/0294494 | A1 * | 10/2014 | Corden | 403/345 |

* cited by examiner

*Primary Examiner* — Thomas B Will
*Assistant Examiner* — Katherine Chu
(74) *Attorney, Agent, or Firm* — Northern Michigan Patent Law, PLC

(57) ABSTRACT

A semi-permanent walkway construction comprising multiple sections of walkway decking configured to be longitudinally connected by rail and splicer structure on lower surfaces of the decking. The rail and splicer structure is generally U-shaped and mates in a male/female fashion, with the rails downward-facing, and the splicers upward-facing with perforated bottom walls so that the rail and splicer structure buries itself in soft terrain to anchor the joined walkway sections. In a further form, a junction rail is provided to create a welding shelf to connect walkway sections in lateral and parallel configurations in addition to the longitudinal configuration provided by the rails and splicers.

6 Claims, 11 Drawing Sheets

DECKING WALKWAY FOR BEACHES AND OTHER SOFT TERRAIN

RELATED APPLICATIONS/PRIORITY BENEFIT CLAIM

This application claims the benefit of U.S. Provisional Application No. 61/925,968, filed Jan. 10, 2014 by the same inventor (Welch), the entirety of which provisional application is hereby incorporated by reference.

FIELD

The subject matter of the present application is in the field of semi-permanent walkways for beaches and other soft terrain areas such as playgrounds surfaced with gravel or wood chips.

BACKGROUND

Pedestrian access to beaches, playgrounds and other soft terrain areas is often improved with hard-surfaced walkways, especially for people whose mobility is limited by physical handicap or reliance on mobility aids such as canes, crutches, walkers, scooters, or wheelchairs.

Depending on budget, location, or regulation, it is not always possible to install a permanently anchored walkway on a beach, playground, wetland trail, etc. (hereafter "beach", collectively). Accordingly, semi-permanent walkways surfaced with decking have become popular.

Important considerations for such semi-permanent walkways include the occasional need to modify or add to the original walkway configuration, for example with lateral offshoots, T's, rest platforms, or widened sections. It might also be necessary to remove the walkways for maintenance, whether of the beach or of the walkway structure itself. Flexibility and ease of installation and modification are therefore desirable.

Another important consideration is the structural support provided to the decking material, often vinyl or a similar molded polymer, and the stability of joints between decking sections.

It has been known to use joined sections of vinyl decking for such walkways, temporarily anchored in the sand of the beach. One such prior decking known to have been used for such walkways is shown in U.S. Pat. No. 5,950,377 to Yoder, which discloses vinyl planks and sections joined and anchored by clips. This decking structure requires a supporting frame, not always practical in the beach environment, and it is believed that when this decking was used for semi-permanent beach walkways it was anchored to a galvanized steel support channel.

Another prior non-permanent beach walkway is disclosed in U.S. Pat. No. 5,820,294 to Baranowski. This walkway is a flexible, extended, rollable perforated mat wide enough to accommodate a wheelchair, but is a more temporary and smaller-scale solution than envisioned in the present application.

BRIEF SUMMARY

I have invented a walkway decking and supportive connecting structure for use in semi-permanent beach walkways assembled in manageable sections. The inventive walkway comprises sections of decking with lower surfaces having sufficient solid surface area to "float" or rest on top of soft terrain, and connecting structure comprising parallel longitudinal rails secured to the lower surface of each section. The rails have a generally U-shaped downwardly-facing cross-section enabling them to be buried in the sand of the beach essentially up to the lower surface of the decking. The rails of mating walkway sections are joined by upward-facing, open-ended, U-shaped connectors or "splicers", with perforated bottoms having large openings that freely admit sand into their interiors when the sections are dropped onto the sand and agitated. The splicers bury and anchor themselves in the sand almost as efficiently as the downward-facing rail sections, and securely join the walkway sections.

In a further form, each walkway section includes at least two spaced parallel support rails whose ends terminate at the front and rear ends of the walkway section. A splicer is secured to an end of a support rail at one end of a first walkway section, with a forward portion of the splicer extending beyond the end of the first walkway section to engage a corresponding support rail in a second mating section. In a preferred form, each support rail on the first walkway section is provided with a splicer extending from the same end of the walkway section, such that the walkway section has a "male" end with projecting splicers, and a "female" end with open support rails.

In one version, the forward end of the splicer has a "closed" configuration in which it is secured to the corresponding rail in the next walkway section with a cross-member such as a through-bolt or pin extending perpendicularly through aligned holes in the sidewalls of the splicer (and in the sidewalls of the rail). This structure mechanically secures the splicer and rail laterally, longitudinally, and vertically, providing the strongest joint where walkway sections are mated.

In a second version, the forward end of the splicer has an "open" configuration, in which open-ended slots in the splicer sidewalls are configured to mate longitudinally with a preinstalled cross-member in the end of the corresponding support rail in the next walkway section. This structure provides a very convenient method of joining the rails of two walkway sections, but does not provide longitudinal stability to the joint.

In yet a further form, a walkway section is provided with both "closed" and "open" configuration splicers. Outer support rails near the sides of the walkway are provided with closed-end splicers for strength, and inner support rails are provided with open-end splicers for ease of assembly and disassembly in the sand.

In yet a further form, a junction rail with a generally J-shaped configuration is provided to join longitudinal sections of walkway in parallel or perpendicular fashion, rather than in series. The junction rail includes an upwardly-facing channel configured to receive the downwardly-facing sidewall of a support rail. The junction rail further includes a horizontal upper shelf at the height of the lower surface of the decking, the shelf serving to provide a welding platform for attaching a splicer or connecting plate and/or to support the decking above.

These and other features and advantages of the invention will become apparent from the detailed description below, in light of the accompanying drawings.

DETAILED DESCRIPTION

Figure 1:
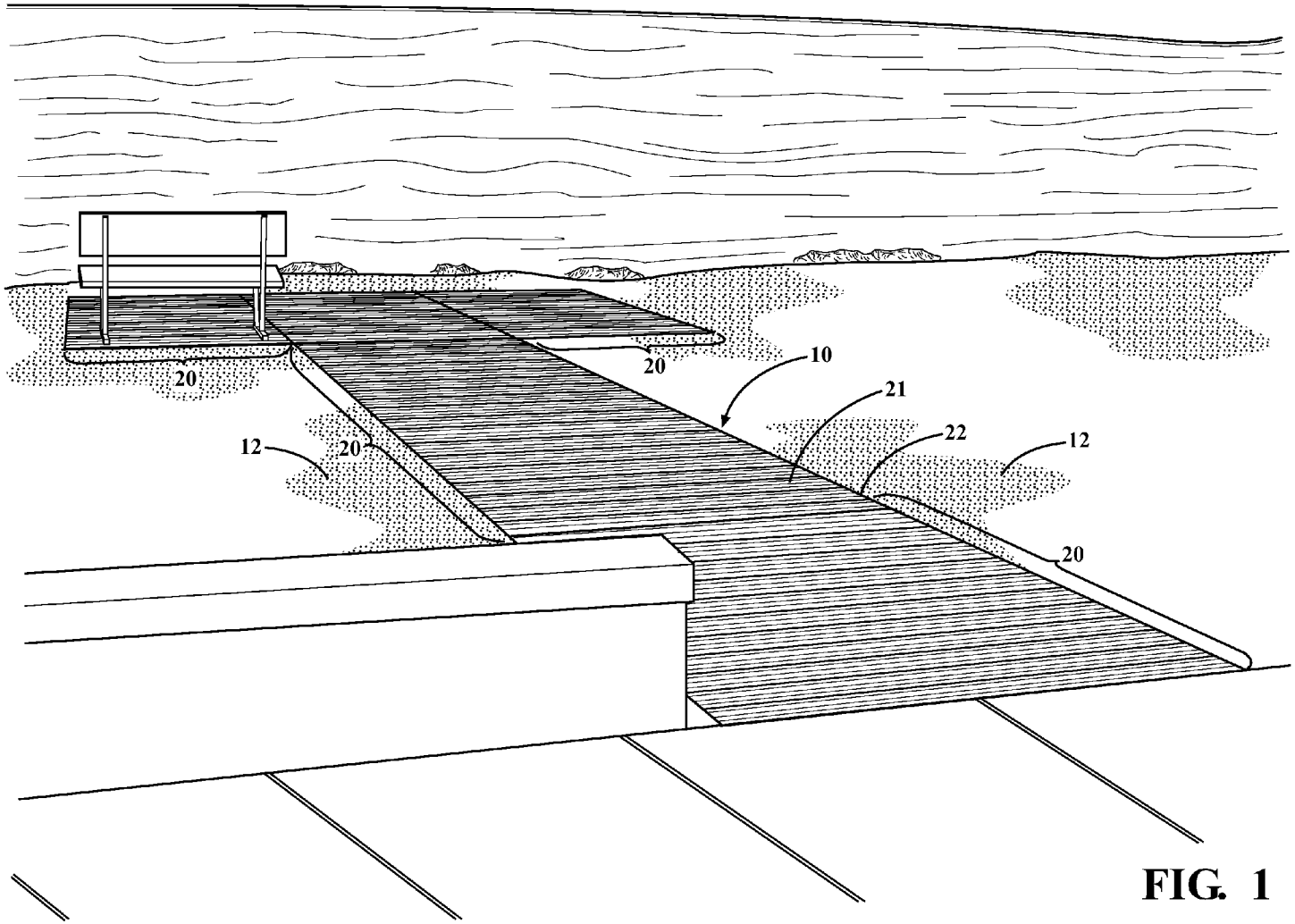
FIG. 1 is a perspective view of an example walkway installed on a beach according to the present invention.

Referring first to FIG. 1, a beach walkway 10 is shown in exemplary form. Walkway 10 is formed from joined walkway sections 20, for example surfaced with vinyl decking 22 in known manner. Decking 22 has an upper walking surface 21, and a lower surface in contact with the beach sand 12. Walkway sections 20 are supported and connected by a system of longitudinal rails and splicers secured to the lower surface of each section and subsequently buried in the sand 12 when the sections 20 are placed face-down on the sand. Walkway 10 is stable and substantially rigid, capable of supporting the weight of multiple people and/or mobility aids on any given section 20 without deforming or sinking into the sand.

Figure 2:
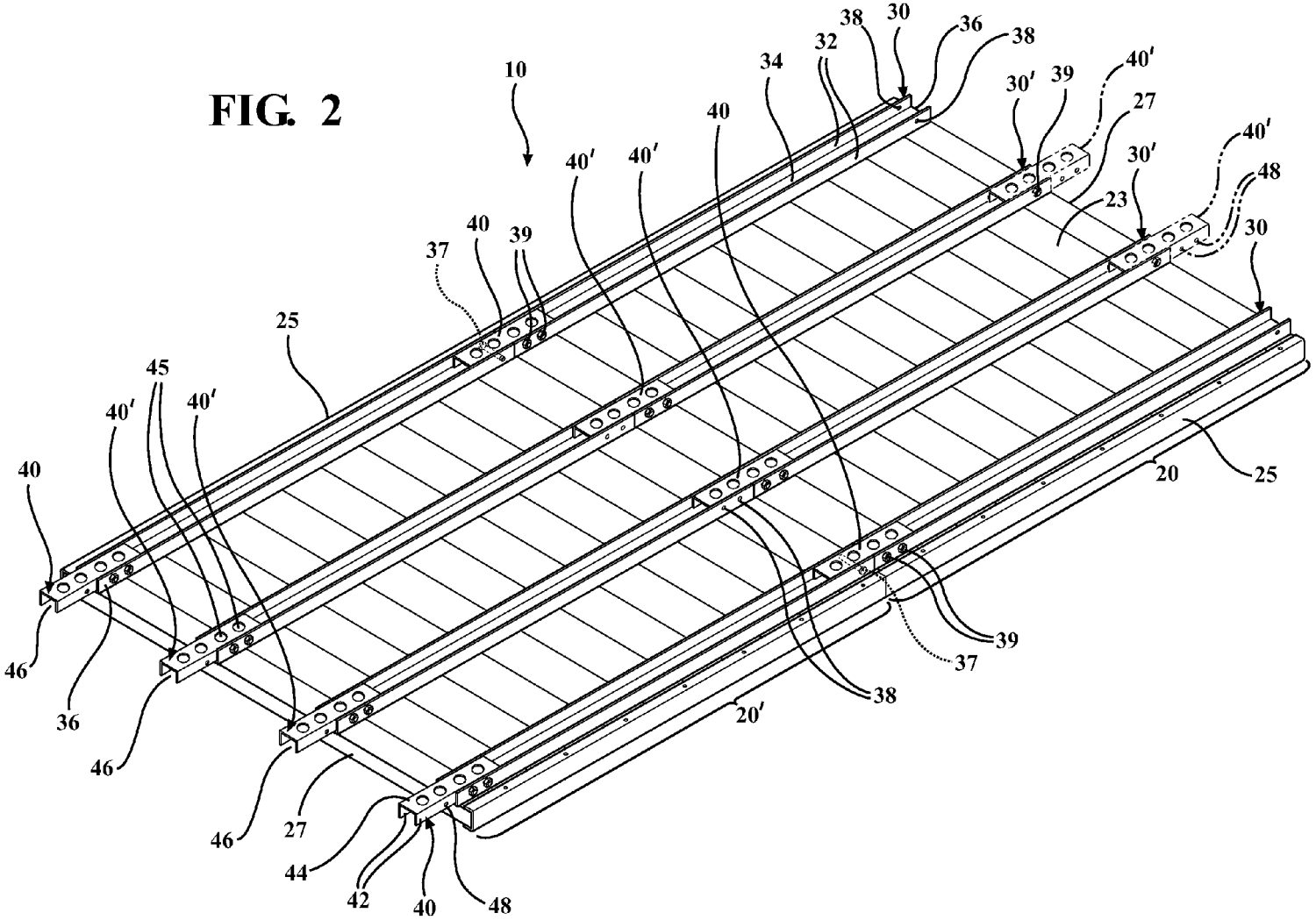
FIG. 2 is a bottom perspective view of two joined sections of walkway from FIG. 1, using a first type of splicer connection.

FIG. 2 shows the lower side of two joined walkway sections 20, with a first section labeled 20 and a second mating section labeled 20'. Sections 20 and 20' in the illustrated example are identical, unless otherwise noted. The sections 20 may be of any length, for example six to eight feet, and the width may vary depending on the intended use and expected traffic.

Figure 14:
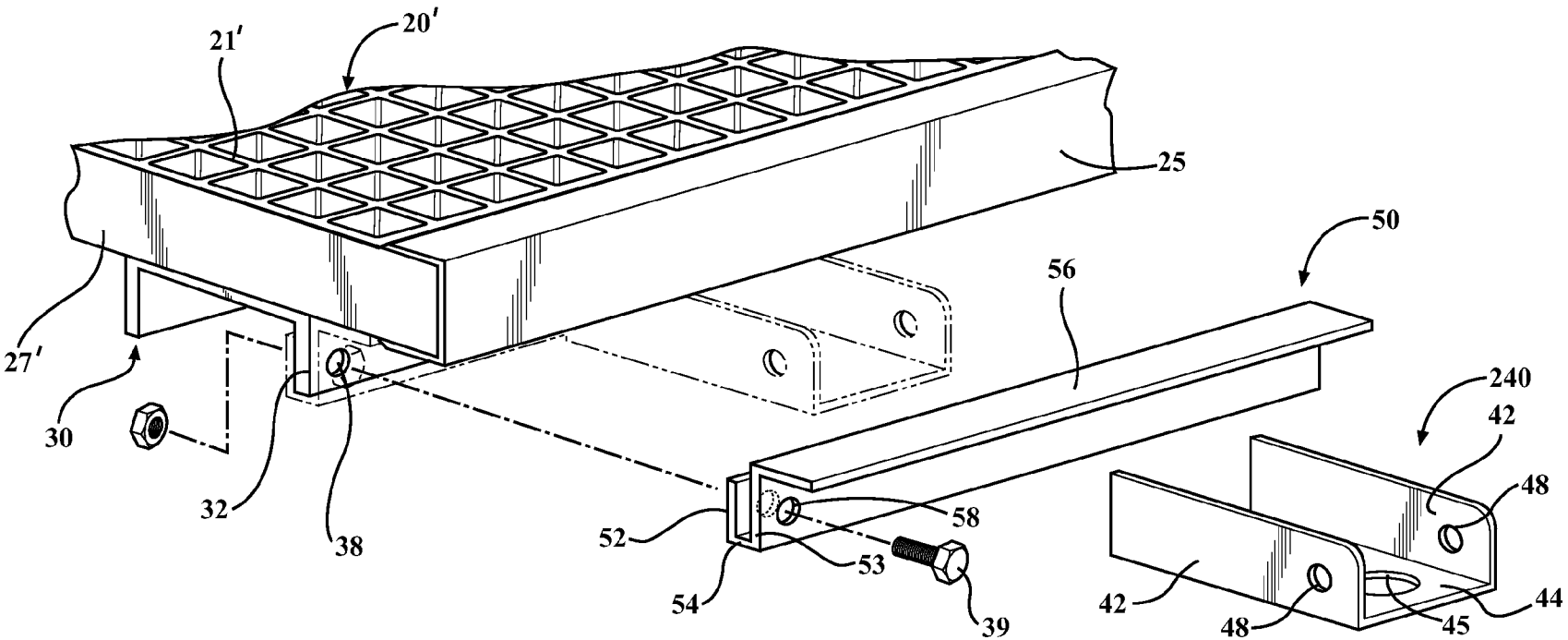
FIG. 14 is similar to FIG. 9, but illustrates a perforated or grate-type decking option.

The bottom surface 23 of decking 22 in sections 20 is essentially solid, sufficiently so that sand, gravel, wood mulch, or other soft or particulate ground material (hereafter "sand" for convenience) generally does not work its way up into any hollow interior in the decking material 22, or up through the decking material 22 to the upper walking surface 21. While the illustrated decking material has the appearance of planking with small gaps between adjacent planks, the decking may be molded or formed from a solid sheet or web of material and given the appearance of separate planks. The decking may have any other external appearance desired, and it would also be possible to have decking material 22 formed from individual planking, with or without spacing between the planks, provided that any spacing between planks is sufficiently small to prevent undue filtration of sand, gravel, wood chips, etc. up through the gaps, and to prevent undue settling of the decking into the sand, gravel, etc. over time—this would meet the definition of an essentially solid lower surface 23 as used herein. It has been found that perforated decking or grating may also be used, provided the lower surface area 23 has sufficient solid area to "float" the decking on the typical soft terrain. An example is shown in FIG. 14, where decking 20' has the form of a grate pattern, perforated between upper and lower surfaces 21', 23' to allow dune grass or similar vegetation to receive sunlight and grow through the decking, and for improved traction in snowy conditions.

Figure 3:
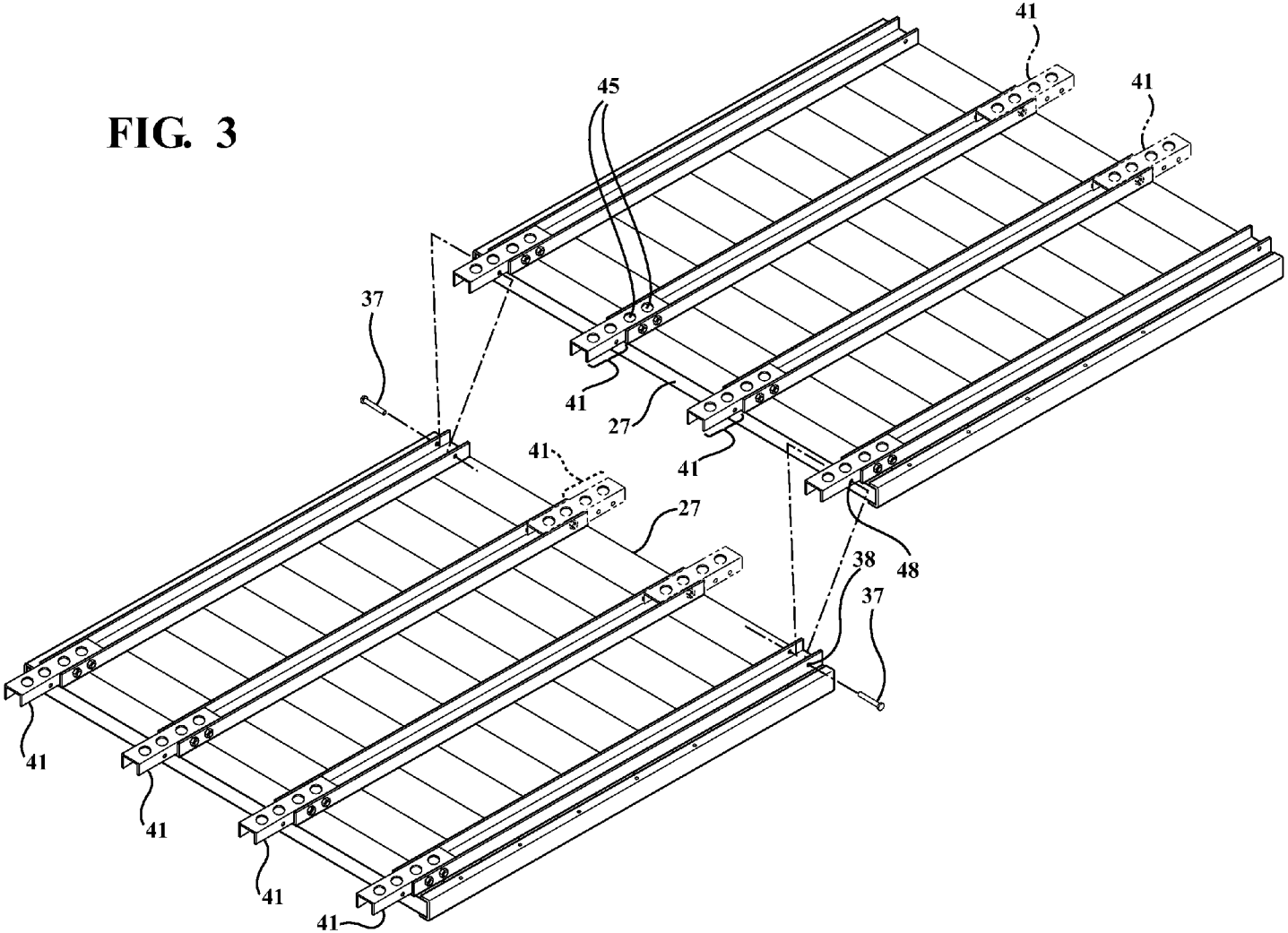
FIG. 3 is an exploded assembly view of the walkway sections of FIG. 2.

Referring to FIGS. 2 and 3, the lower surfaces 23 of walkway sections 20 are provided with at least two outer parallel support rails 30, and in the illustrated example with one or more interior support rails 30' essentially identical and parallel to rails 30. Rails 30 and 30' (hereafter referred to simply as rails 30, unless a distinction is being drawn between the inner and outer rails) are structurally rigid, for example made from a metal such as aluminum or steel. Rails 30 can be secured in various ways to the undersides 23 of their respective walkway sections 20, for example with screws or adhesives, although other methods are acceptable. It might also be possible to mold rails 30 into the lower surfaces of sections 20 when the decking is being formed, for example by insert molding metal rails into the decking, or by molding the rails from the material of the decking itself—in such case, rails 30 might comprise sidewalls 32 extending directly from lower surface 23 of the decking, with lower surface 23 of the decking functioning as the "base" of the rail. It should be understood that the materials used for walkway 10 are not limited to the illustrated combination of polymer/vinyl decking and metal rails, although this combination is currently preferred.

Rails 30 have a generally U-shaped cross section, with sidewalls 32 joined by a base 34, the base being secured to lower surface 23 of the decking section 20 so that the rail opens downwardly, into the sand, when the decking section 20 is placed lower side down on the beach. The open ends 36 of rails 30 terminate at or near the mating longitudinal ends 27 of the decking sections, in the preferred form being essentially flush therewith. Rails 30 also include aligned pairs of holes 38 in their sidewalls 32 near ends 36, for receiving splicer-securing cross members such as pins or cross-bolts 37, 39 in various arrangements described below. A generally squared U-shape is preferred for the rail/splicer cross sections, as illustrated, although rounded U-shapes are possible where sidewalls 32 are part of a single continuously-curved wall.

Rails 30 on adjacent decking sections 20 are aligned with one another, at least at their ends, and are connected with splicers 40. Splicers 40 are short, open-ended, generally U-shaped channels, similar in shape to rails 30 but sized so that their sidewalls 42 fit inside (illustrated, best shown in FIG. 5) or optionally over the sidewalls 32 of rails 30—the mating configuration could be described generally as a hollow male/female fit. Splicers 40 have perforated bases or bottoms 44 with large holes 45 to freely admit sand into their interiors through the bottom. Splicers 40 are installed facing upwardly into rails 30, such that bottoms 40 are in contact with the sand when the decking sections are installed on a beach. The ends 46 of splicers 40 are open. The sidewalls 42 of splicers 40 include aligned pairs of holes 48 mating with those on the sidewalls of the ends of rails 30 for receiving pins and/or cross-bolts 37, 39 to secure them to rails 30.

FIGS. 2 and 3 show a first type of splicer connection between adjacent walkway sections 20, in which each section has two outer rails 30 and at least one and preferably two inner rails 30'. One end of the walkway section is defined as "male" by four identical splicers 40 secured at one end in the four rails 30, with the free ends 41 of the splicers projecting beyond the end of the walkway to mate with four corresponding rails 30 in the next section 20. Splicers 40 are accordingly first secured or pre-installed in a semi-permanent manner with cross-bolts 39 to the male end of the first section 20 of walkway, and subsequently mated with the female end of the next section 20' of walkway, whereupon the free ends of the outer splicers 40 are secured with more easily installed and removed detent-type pins 37 to the open rail ends in section 20'. The splicers 40 on the inner rails 30' (hereafter referred to as 40' to distinguish their manner of connection) may be left unsecured in their respective inner female rails 30' on the next section 20, or if access is possible they could be secured to the inner rails 30' with pins or bolts. If left unsecured to inner rails 30' on the next section 20', the free ends 41 of inner splicers 40' still provide lateral and some vertical stability to the joined walkway sections by virtue of their mating fit with the ends of inner rails 30'.

An alternate connection is shown in phantom in FIGS. 2 and 3, in which inner splicers 40' are secured at the opposite end of section 20, such that each walkway section 20 has two outer splicers 40 projecting from a first end and two inner splicers 40 projecting from a second, opposite end. The manner of securing the free ends 41 of the pre-installed splicers 40 and 40' to their adjoining walkway sections 20 may be the same as described above.

Figure 4:
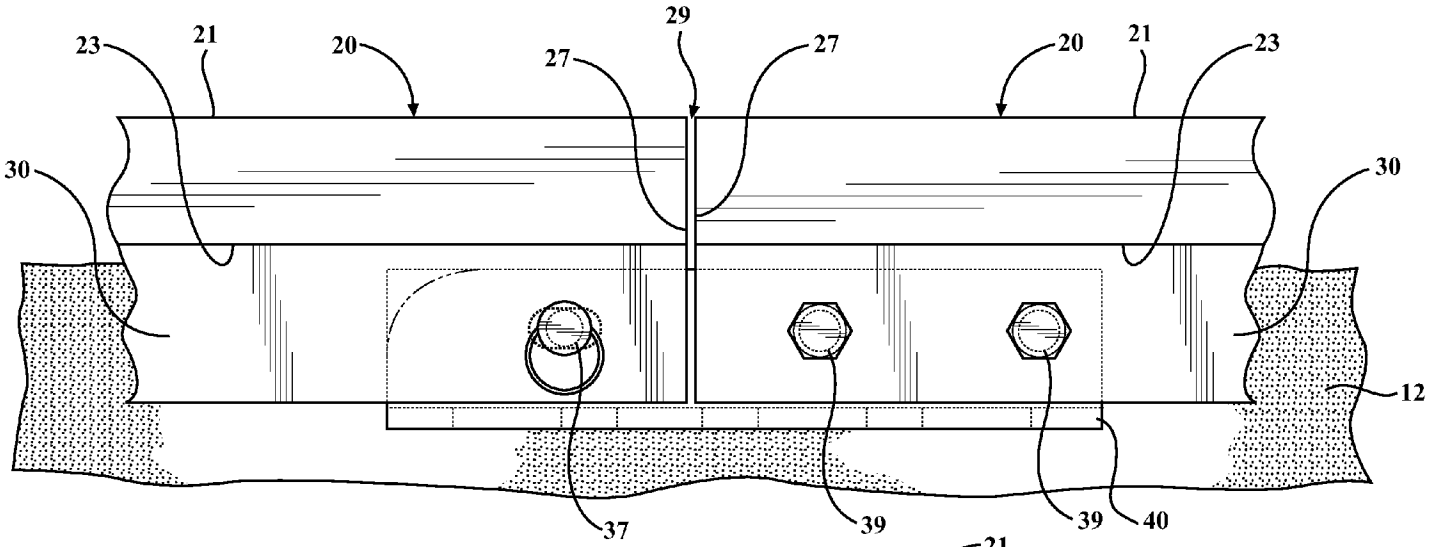
FIG. 4 is a side elevation view of one of the outer splicer joints from FIG. 2.
Figure 5:
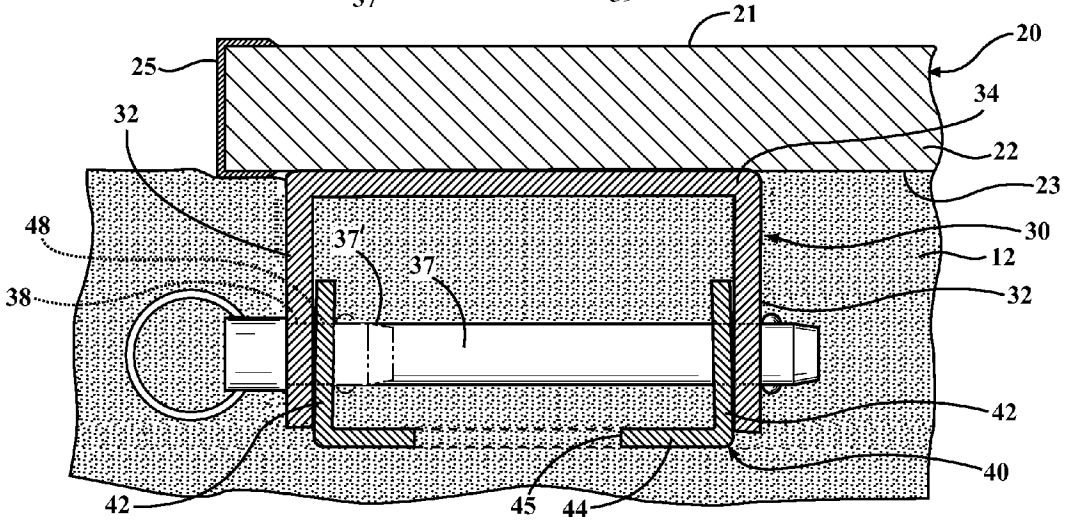
FIG. 5 is an end elevation view of the splicer joint of FIG. 4, further illustrating the splicer joint filled with sand.

FIGS. 4 and 5 illustrate one of the splicer/rail connections 40/30 from FIGS. 2 and 3 at the joint 29 of two walkway sections 20. The illustrated connection is one of the outer rail/splicer connections using a detent-type pin 37. (It will be understood that FIGS. 4 and 5 also generally represent the inner splicer/rail connections 40'/30', with the exception of the connector pin 37.) Rails 30 are essentially buried in sand 12, near or up to the lower surface 23 of the decking 22 of sections 20, and their open bottoms are accordingly filled with sand, anchoring the walkway sections 20 in the beach. Splicers 40 are likewise buried in sand 12, and with their perforated bottom walls 44 and open ends 46 they fill with sand in a manner very similar to rails 30, with perhaps some minor agitation in the sand to assist.

FIG. 5 shows preferred mating cross sections for rail 30 and splicer 40, with the rail sidewalls 32 being angled at right angles relative to their base 34, while splicer sidewalls 42 are angled inward relative to splicer base 44, e.g. at 88 degrees or so. This preferred configuration permits relatively unimpeded initial vertical mating of the splicer and rail. It is also possible to have both rail and splicer sidewalls equally right-angled to permit free vertical mating and separation. It also should be understood that while the illustrated splicer 40 fits inside rail 30, the splicer could be sized to fit over rail 30 with a similar fit.

Figure 6A:
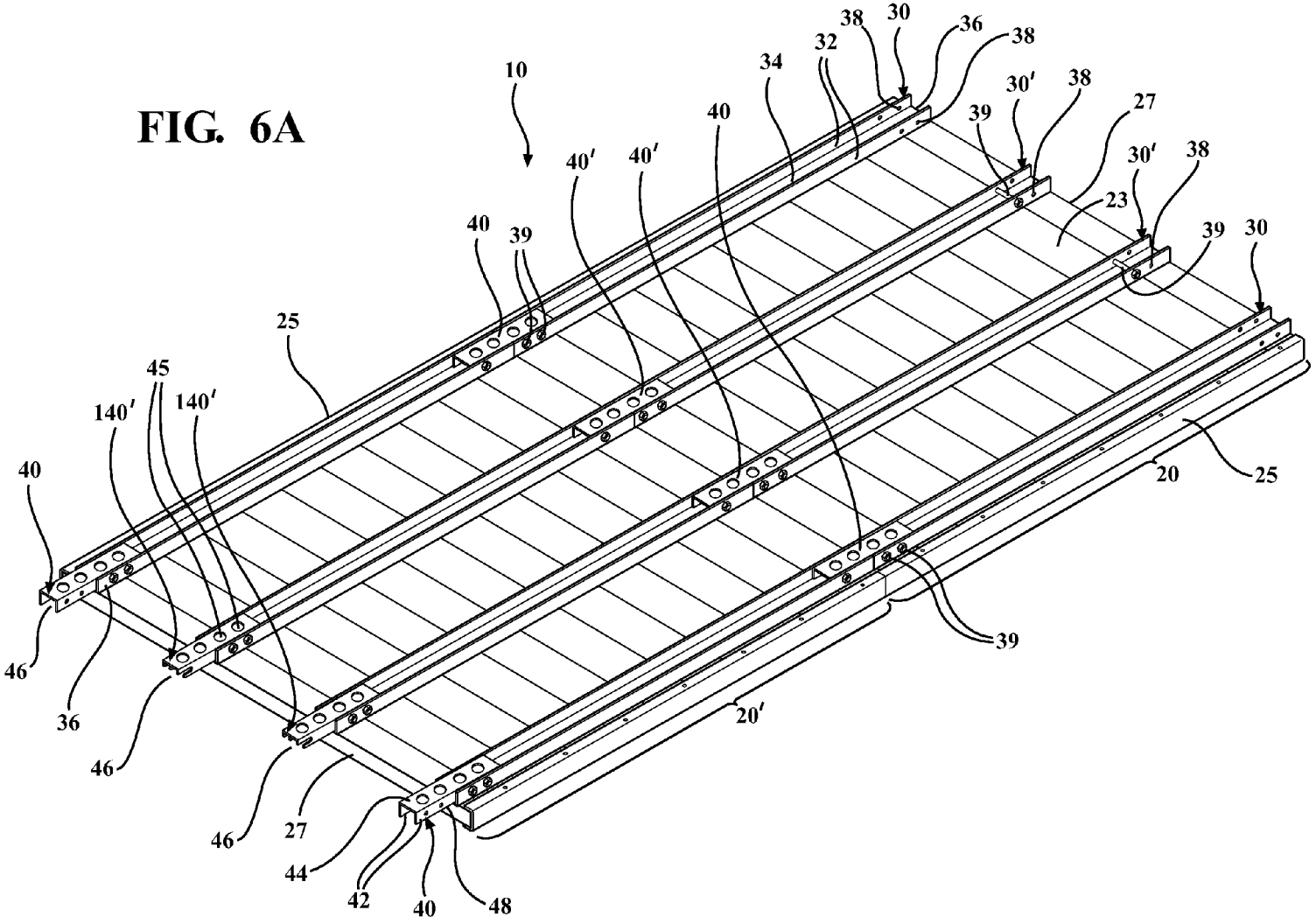
FIG. 6A is a bottom perspective view of two joined sections of walkway from FIG. 1, using a second type of splicer connection for the interior splicers.
Figure 6B:
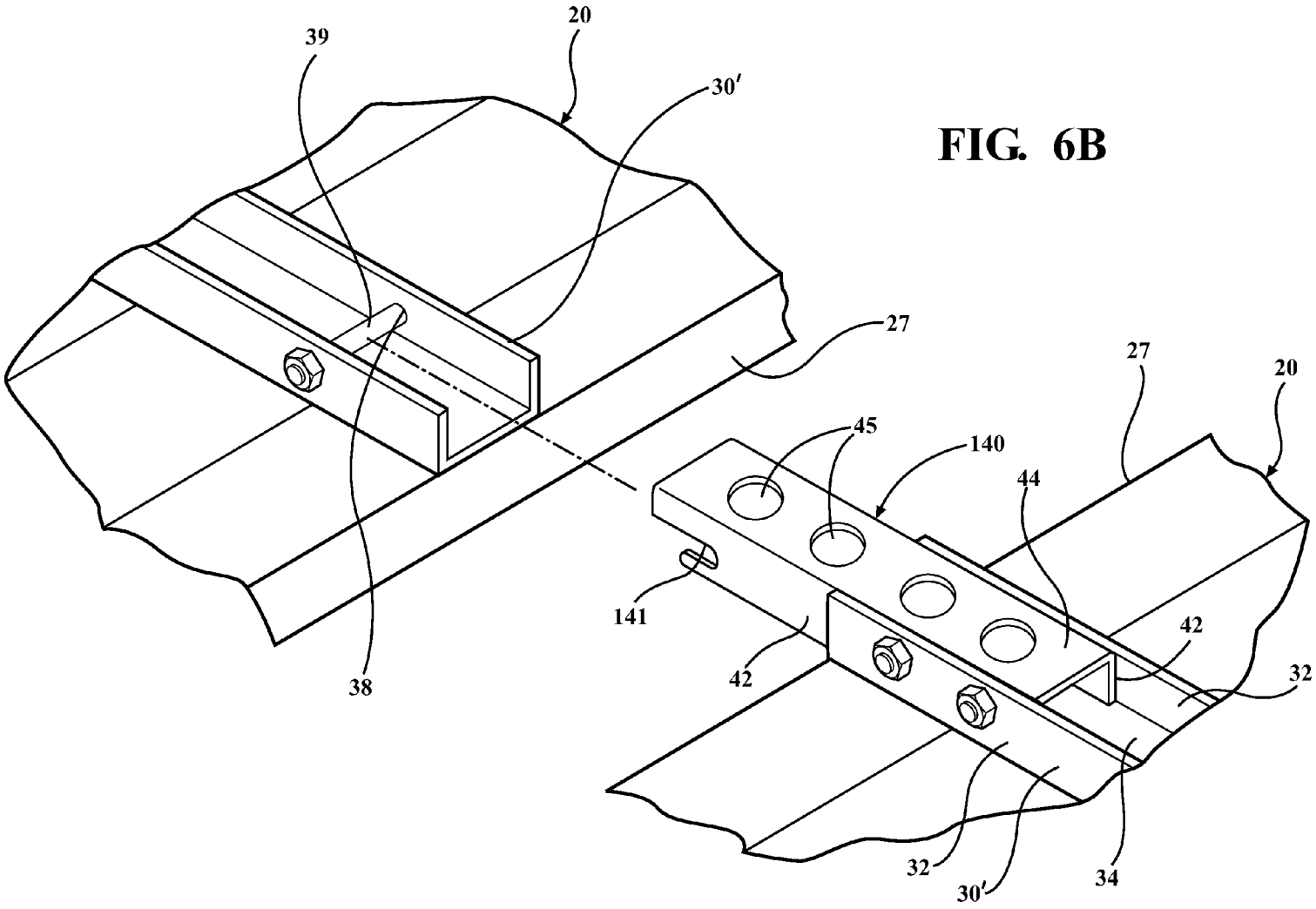
FIG. 6B is an exploded assembly view of one of the interior splicer connections of FIG. 6A.
Figure 7:
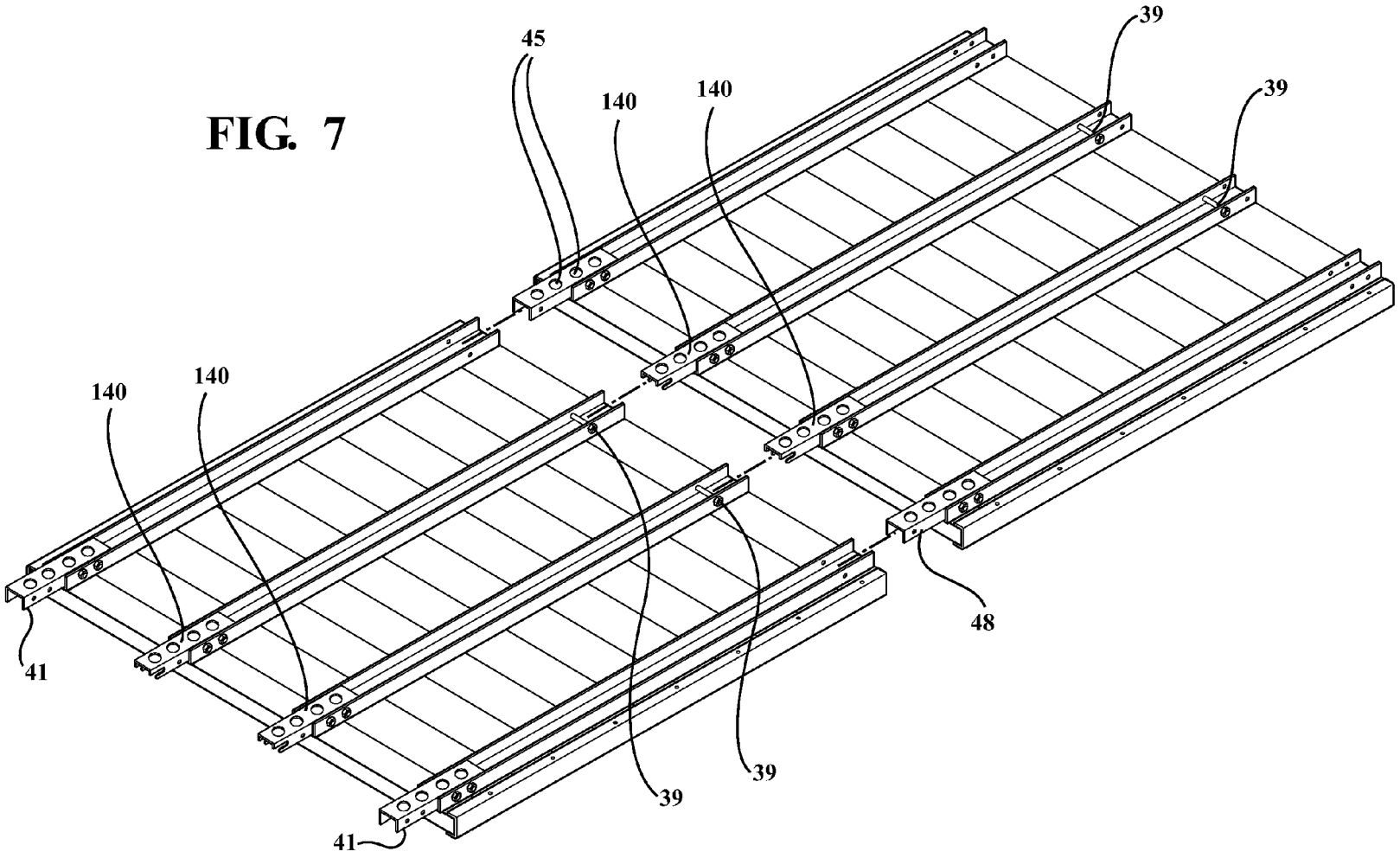
FIG. 7 is an exploded assembly view of the walkway sections of FIG. 6A.
Figure 8:
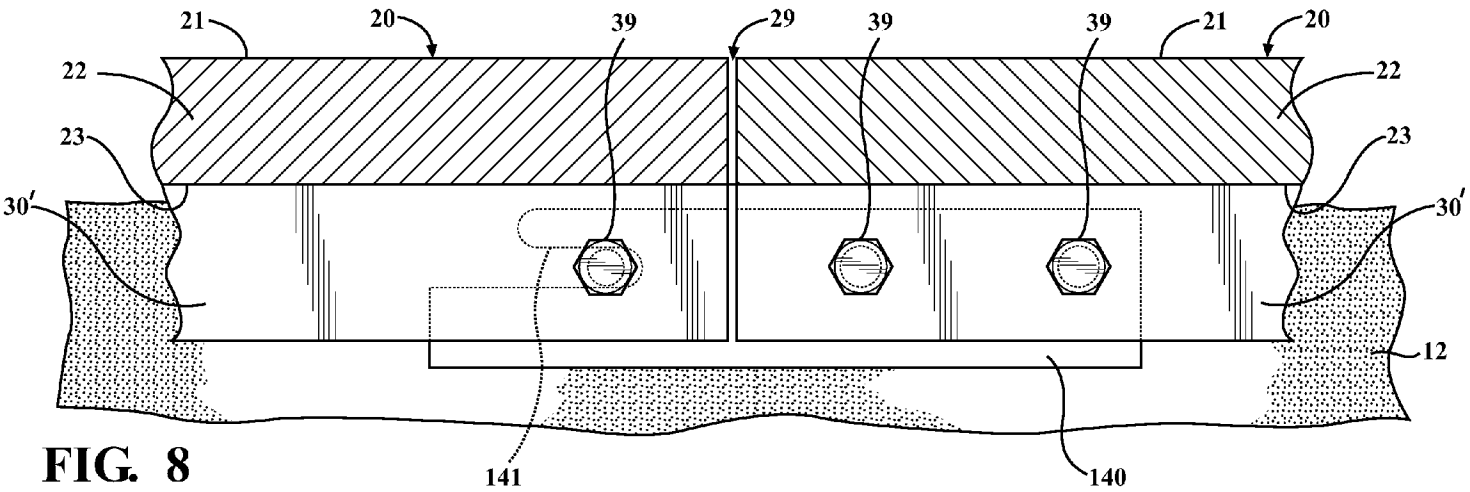
FIG. 8 is a side elevation view of one of the inner splicer joints using the second type of splicer from FIG. 6A.

FIGS. 6A, 6B, 7 and 8 show another type of splicer connection in which the inner splicers 140 have a different configuration than outer splicers 40, and in which a different type of connection is used to secure the inner splicers 140 to inner rails 30'. Inner splicers 140 have through-holes 48 at one end, for pre-installation on inner rails 30' with bolts, as shown and described above with respect to FIGS. 2 and 3. However, the outer or free ends 41 of splicers 140 positioned to mate with the inner rails 30' on the next walkway section 20 are provided with open-ended slots 141. Slots 141 are configured to mate in longitudinal sliding fashion with pins or bolts such as 37 or 39 pre-installed in the female ends of the inner rails 30' on the next walkway section 20, as best shown in FIGS. 6B and 7. This allows easier and more secure mating of the inner splicers with the next walkway section, especially when face-down in the sand, and produces a stronger joint at the inner rails than would result from merely mating free ends 41 with the rails.

Figure 9:
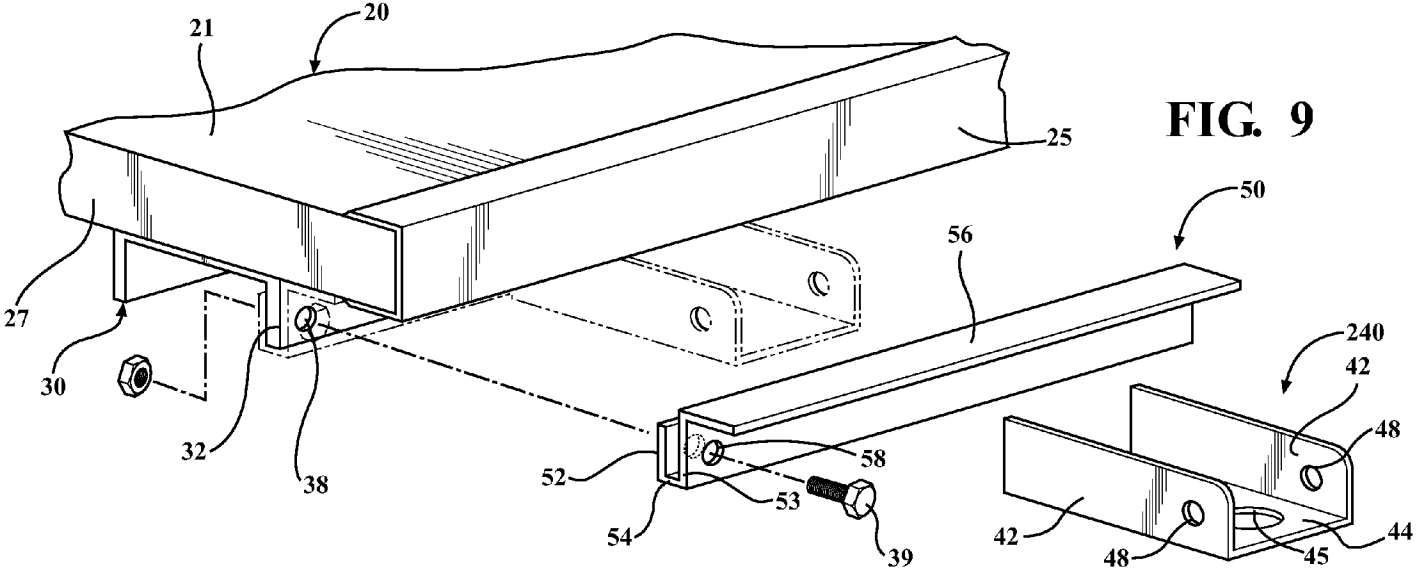
FIG. 9 is a perspective assembly view of a junction rail supplementing one of the support rails in a first walkway section, the junction rail supporting a perpendicular splicer connection to another section of walkway joined perpendicularly to the first section.

FIGS. 9 through 12 illustrate a junction rail useful for creating lateral (perpendicular) and parallel connections between walkway sections 20, versus the longitudinal or series connections described and shown above in FIGS. 1-8. Referring first to FIG. 9, junction rail 50 includes sidewalls 52, 53 joined by a base or bottom 54 and defining an upward-facing channel 55 sized to receive a sidewall 32 from one of support rails 30 in a close fit. Junction rail outer sidewall 53 may be taller than inner sidewall 52, and terminates in a horizontal shelf 56. The height of sidewall 53 and the thickness of shelf 56 are chosen to match the height of support rail sidewall 32, so that shelf 56 fits flush against the lower surface 23 of the walkway section 20. Shelf 56 preferably extends a distance from sidewall 53 equal to or less than the spacing of an outer support rail sidewall 32 from the side edge 25 of the decking portion 22 of walkway section 20.

Figure 10:
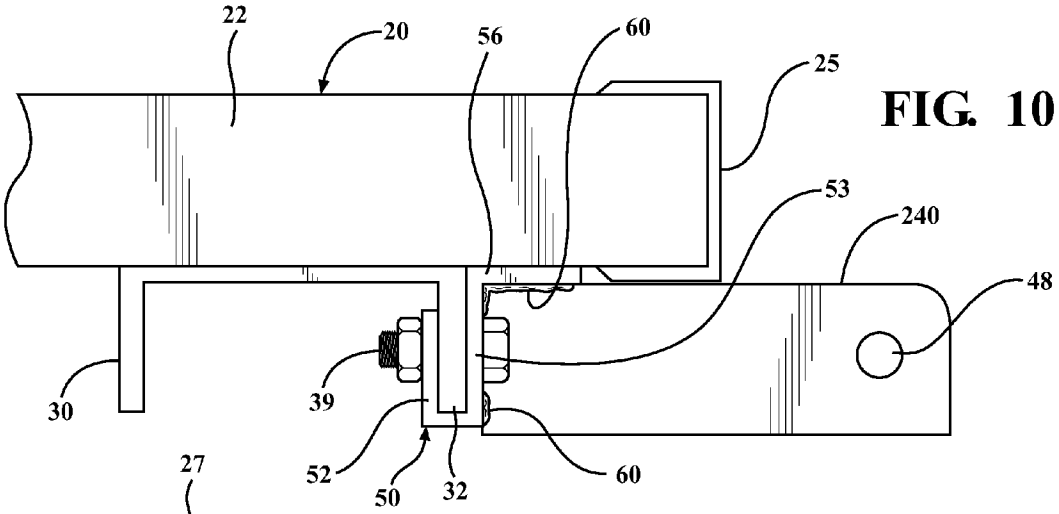
FIG. 10 is an end elevation view of the junction rail and the perpendicular splicer connection of FIG. 9.
Figure 11:
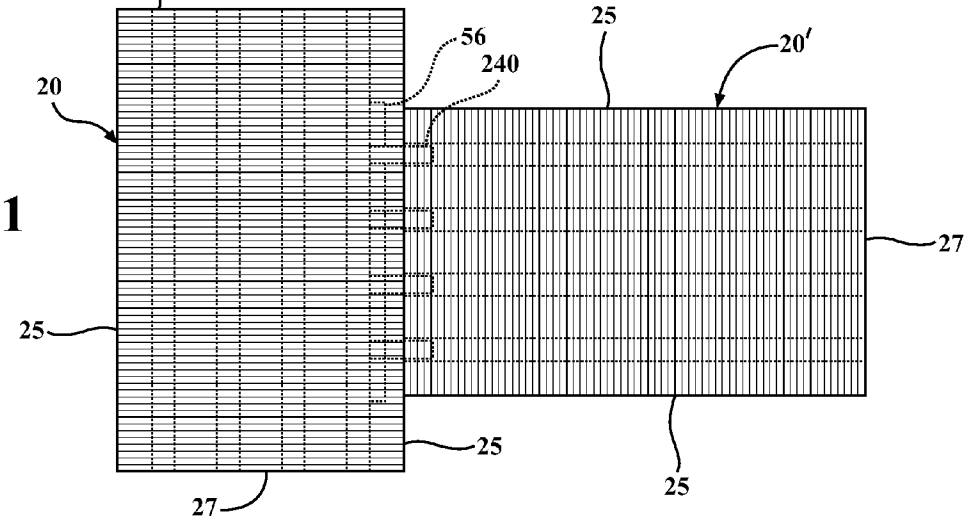
FIG. 11 is a plan view of perpendicularly-joined walkway sections using the junction rail supported splicer connection of FIG. 10.

FIGS. 9, 10, and 11 illustrate a junction rail 50 used to create a lateral connection between a first walkway section 20 and a second walkway section 20' oriented perpendicularly to the first section 20. Junction rail 50, made for example from the same material as rail 30 (e.g., aluminum or steel), is mated with the outer sidewall 32 of an outer support rail 30 on section 20 with the sidewall 32 located in junction rail channel 55. Junction rail 50 may be secured to rail 30 in different ways, but in the illustrated example is provided with holes 58 that can be aligned with the holes already in rail 30 for receiving cross-bolts or pins such as 37 or 39. A splicer 240, similar to splicer 40 above but shortened and squared at the inner end, is secured with welds 60 to the underside of shelf 56 and optionally to the outer surface of sidewall 53, with a free end projecting beyond the edge 25 of the walkway section 20. Normally more than one splicer 240 will be mounted on junction rail 50; for example, four splicers 240 are shown in FIG. 11 to match the illustrated four support rails 30 in the mating walkway section 20'.

Once junction rail 50 and one or more splicers 240 have been secured to the first walkway section 20, another walkway section 20' can be mated perpendicularly to the first section using the free splicer ends, as described and shown above in preceding Figures. The resulting walkway joint is shown in FIG. 11, with a lateral offshoot of walkway 20' extending from the original longitudinal run 20.

It will be appreciated that while junction rail 50 is shown in use for a perpendicular walkway connection, angles other than perpendicular are possible provided that the mating end of the offshoot section of walkway is angled accordingly, and that the splicers 240 on the junction rail are welded onto the shelf 56 at a corresponding angle.

Figure 12:
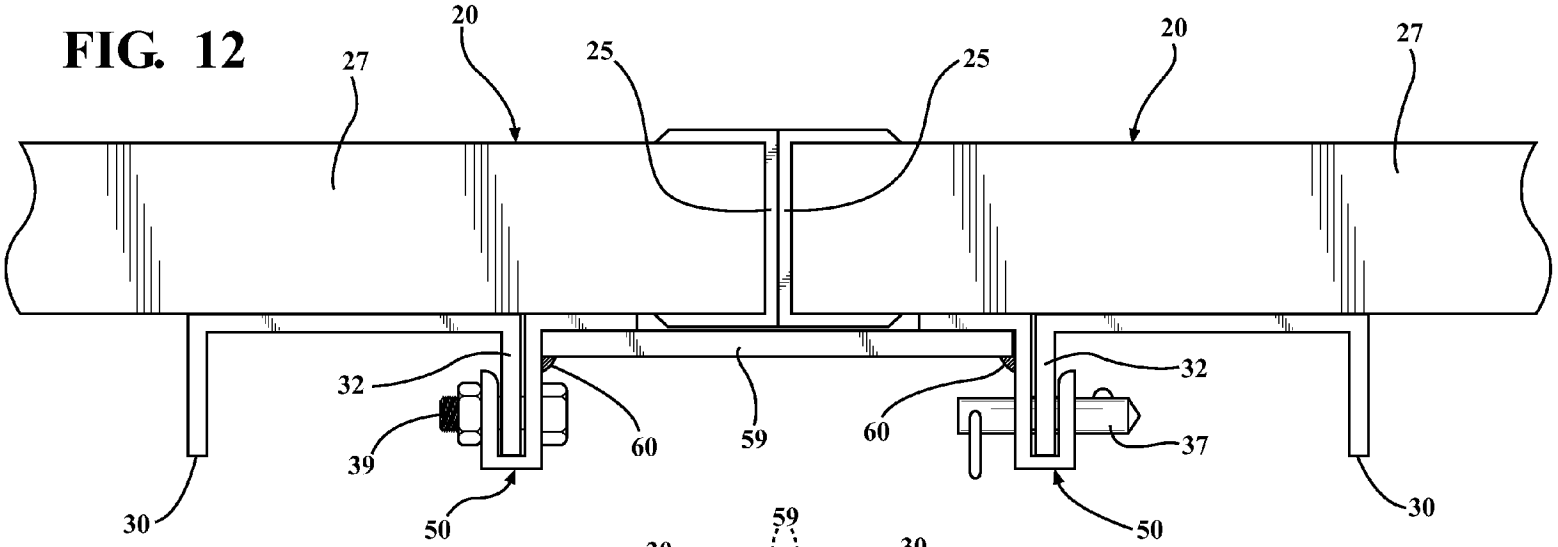
FIG. 12 is an end elevation view of two adjacent sections of walkway joined in parallel with two of the junction rails of FIG. 9 supporting a connecting plate between adjacent support rails.
Figure 13:
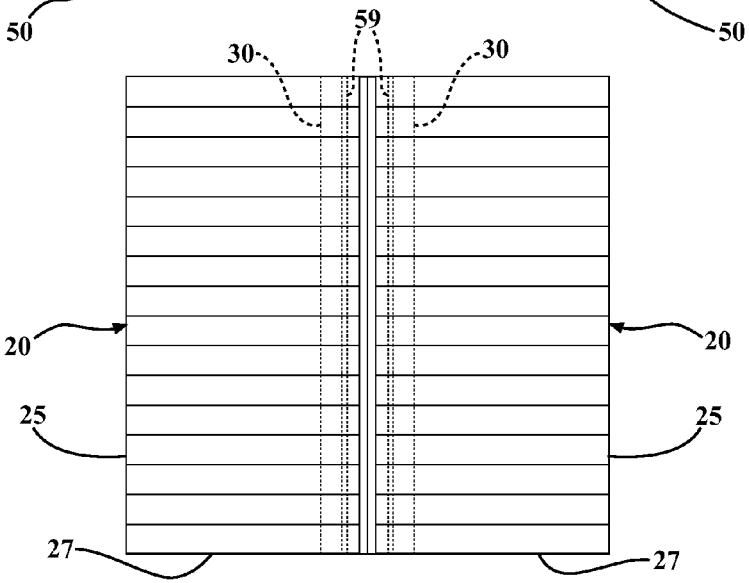
FIG. 13 is a plan view of the walkway sections joined in parallel in FIG. 12.

Referring next to FIGS. 12 and 13, junction rail 50 is shown used in pairs to join sections of walkway 20 in parallel, i.e. with their side edges 25 abutting. A junction rail 50 is secured to each of the adjacent outer support rails 30 at the joint of their respective sections 20 of walkway, and then a junction plate or strip 59 (e.g., aluminum or steel) wide enough to bridge the joint is welded at 60 to the undersides of the shelves 56.

It would also be possible to use junction rail 50 without using the shelf 56 as a weld support for additional connecting structure such as splicers 40 or junction plates 59. For example, securing a junction rail 50 to the sidewall of a support rail 30 would reinforce the decking 22 that extends beyond the support rail 30, by virtue of the contact between shelf 56 and the underside 23 of the decking. This might be especially useful for reinforcing the outer sides 25 of walkway sections 20 that extend beyond the outer support rails 30.

It will be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in any other application claiming priority to this application.

The invention claimed is:

1. A structure for use in semi-permanent walkways on soft terrain, comprising:

first and second walkway sections, each walkway section comprising a decking portion comprising a lower surface, sides, and two longitudinal ends at least one of which is a mating end, substantially parallel support rails extending substantially the full length of the walkway section along the lower surface between the two longitudinal ends, each support rail comprising an end adjacent the mating end and further comprising spaced sidewalls extending downwardly away from the lower surface of the decking portion, the spaced sidewalls terminating in spaced terminal edges defining a substantially lowermost portion of each walkway section, each support rail further defining alone or in combination with the lower surface of the decking portion a generally U-shaped downwardly-facing open cross-section along substantially the entire length of the support rail;

generally U-shaped splicers shorter than the support rails and comprising first ends mated with respective ends of at least some of the support rails at the mating end of the first walkway section, and comprising second ends extending beyond the mating end of the first walkway section and the respective ends of the support rails to which they are mated and mating with corresponding ends of corresponding support rails on the mating end of the second walkway section such that the second walkway section is mated with the first walkway section at the support rails by the splicers longitudinally bridging the first and second walkway sections, the splicers each comprising generally U-shaped members comprising spaced sidewalls joined by a perforated bottom wall and spaced to fit within or over the sidewalls of the respective and corresponding ends of the support rails to which they are mated on the first and second walkway sections with the perforated bottom wall spaced from the lower surfaces of the decking portions and substantially even with the terminal edges of the support rail sidewalls, the perforated bottom wall comprising openings configured to freely admit soft terrain to substantially fill the splicer when the joined walkway sections are face down on soft terrain;

wherein the support rails of each walkway section comprise two outer support rails and an inner support rail between the outer support rails;

wherein the outer support rails of the first and second walkway sections are each joined by one of the splicers secured longitudinally to the respective and corresponding ends of the outer support rails at the mating ends of the walkway sections, and the inner support rails of the first and second walkway sections are joined by one of the splicers secured longitudinally to the respective or corresponding end of the inner support rail of one of the first and second walkway sections at its mating end and secured laterally but not longitudinally to the respective or corresponding end of the inner support rail of the other of the first and second walkway sections at its mating end;

wherein each outer support rail is joined by an outer splicer comprising first and second ends secured to the respective and corresponding ends of the outer support rails of the first and second walkway sections with one or more cross-members extending through the sidewalls of each of the outer support rails and the outer splicer first and second ends, and wherein the inner support rails are joined by an inner splicer comprising a first end having an open-ended longitudinal slot formed in each sidewall thereof, and further wherein the inner support rail on a mating end of one of the first and second walkway sections includes an inner cross-member received longitudinally in the open-ended longitudinal slot on the inner splicer.

2. The structure of claim 1, wherein the sidewalls of the inner splicer comprise a shorter upper sidewall portion terminating inwardly of a terminal end of the inner splicer and a longer lower sidewall portion terminating at the terminal end of the inner splicer and contiguous with the perforated bottom wall, and further wherein the open-ended longitudinal slots are defined between the shorter upper sidewall portions and longer lower sidewall portions such that the perforated bottom wall and the longer lower sidewall portion extend farther beyond the inner cross-member than the upper shorter sidewall portion.

3. The structure of claim 1, wherein the ends of the support rails are essentially flush with the mating ends of the first and second walkway sections.

4. A structure for use in semi-permanent walkways on soft terrain, comprising:

first and second walkway sections, each walkway section comprising a decking portion comprising a lower surface, sides, and two longitudinal ends at least one of which is a mating end, substantially parallel support rails extending substantially the full length of the walkway section along the lower surface between the two longitudinal ends, each support rail comprising an end adjacent the mating end and further comprising spaced sidewalls extending downwardly away from the lower surface of the decking portion, the spaced sidewalls terminating in spaced terminal edges defining a substantially lowermost portion of each walkway section, each support rail further defining alone or in combination with the lower surface of the decking portion a generally U-shaped downwardly-facing open cross-section along substantially the entire length of the support rail;

generally U-shaped splicers shorter than the support rails and comprising first ends mated with respective ends of at least some of the support rails at the mating end of the first walkway section, and comprising second ends extending beyond the mating end of the first walkway section and the respective ends of the support rails to which they are mated and mating with corresponding ends of corresponding support rails on the mating end of the second walkway section such that the second walkway section is mated with the first walkway section at the support rails by the splicers longitudinally bridging the first and second walkway sections, the splicers each comprising generally U-shaped members comprising spaced sidewalls joined by a perforated bottom wall and spaced to fit within or over the sidewalls of the respective and corresponding ends of the support rails to which they are mated on the first and second walkway sections with the perforated bottom wall spaced from the lower surfaces of the decking portions and substantially even with the terminal edges of the support rail sidewalls, the perforated bottom wall comprising openings configured to freely admit soft terrain to substantially fill the splicer when the joined walkway sections are face down on soft terrain, and, further including a junction rail comprising spaced inner and outer sidewalls joined by a base and defining a channel, and an outer shelf extending horizontally from the outer sidewall, the channel configured to receive an outer sidewall of an outer support rail on one of the first and second sections of walkway in a close fit, and further wherein the height of the outer shelf from the base of the junction rail is approximately equal to the height of the sidewall of the support rail relative to the lower surface of the decking, such that the junction rail is secured to the outer sidewall of the support rail with the outer shelf in contact with the lower surface of the decking.

5. The structure of claim 4, wherein a third walkway section substantially identical to the first and second walkway sections is mated to one of the first and second walkway sections in perpendicular relationship thereto, with a side of the one of the first and second walkway sections abutting a mating end of the third walkway section, and further wherein an additional splicer is welded to the underside of the outer shelf and extends laterally from the abutting side of the one of the first and second walkway sections and mates with a support rail on the third walkway section.

6. The structure of claim 4, wherein a third walkway section substantially identical to the first and second walkway sections is mated to one of the first and second walkway sections in parallel relationship thereto with abutting sides, and wherein a pair of junction rails is secured to adjacent outer sidewalls of adjacent outer support rails on the third walkway section and on the one of the first and second walkway sections in opposing fashion, and further wherein a connecting plate is welded to the undersides of the outer shelves of the opposing junction rails to bridge the sides of the parallel abutting walkway sections.

* * * * *